US012629605B2

(12) United States Patent
Zhang

(10) Patent No.: US 12,629,605 B2
(45) Date of Patent: May 19, 2026

(54) PEN FOR PLANTING SPHERICAL BEADS

(71) Applicant: Shuo Zhang, Shantou (CN)

(72) Inventor: Shuo Zhang, Shantou (CN)

( * ) Notice: Subject to any disclaimer, the term of this patent is extended or adjusted under 35 U.S.C. 154(b) by 396 days.

(21) Appl. No.: 18/401,405

(22) Filed: Dec. 30, 2023

(65) Prior Publication Data

US 2025/0032948 A1 Jan. 30, 2025

(30) Foreign Application Priority Data

Jul. 29, 2023 (CN) ..... 202322015876.0

(51) Int. Cl.
*A63H 33/00* (2006.01)

(52) U.S. Cl.
CPC ..... *A63H 33/00* (2013.01)

(58) Field of Classification Search
CPC ..... A63H 33/00
See application file for complete search history.

(56) References Cited

U.S. PATENT DOCUMENTS

2005/0011803 A1* 1/2005 Chafoulias ..... B65D 83/0481 206/528
2009/0314795 A1* 12/2009 Rapko ..... B25B 23/00 221/251
2011/0011884 A1* 1/2011 Kindel ..... B65D 83/0409 221/279
2012/0055948 A1* 3/2012 Leifeld ..... B65D 83/0418 221/268
2015/0076170 A1* 3/2015 Goettke ..... B65D 83/0409 221/250

* cited by examiner

*Primary Examiner* — Gene O Crawford
*Assistant Examiner* — Ayodeji T Ojofeitimi
(74) *Attorney, Agent, or Firm* — Nicholas Makridakis

(57) ABSTRACT

Disclosed is a pen for planting spherical beads. A hollow hole is formed in a lower end of a pen body. A jacking rod vertically extending in a downward direction and a vertical sliding component are under the pen body. A cavity is formed inside the vertical sliding component, a bead inlet hole is formed on the top of the cavity, a bead outlet hole is formed in the bottom of the cavity, the bottom of the vertical sliding component is inclined, and the bead outlet hole is positioned at the lowest end of the cavity of the vertical sliding component. When the vertical sliding component downwards slides to the lowest point of a track relative to the pen body, a vertical distance between the lower end surface of the jacking rod and the bead outlet hole can accommodate a spherical bead.

15 Claims, 14 Drawing Sheets

PEN FOR PLANTING SPHERICAL BEADS

TECHNICAL FIELD

The disclosure belongs to the technical field of a pen for planting spherical beads, and particularly relates to a pen for planting spherical beads capable of being used for planting spherical toy beads onto a substrate material.

BACKGROUND

Toys may be used for simulating daily life scenes. According to a bead embroidered picture in daily life, beads are connected and embroidered onto a substrate material to form bead lines or bead planes to further form pictures. In the field of toys, according to a playing manner designed by people, toy beads are planted onto a substrate material and are connected into bead lines or bead planes to further form pictures, where dense round recessed holes are formed in the substrate material in advance, colorful spherical beads are pushed into the corresponding round recessed holes according to the designed picture-text regions during playing, and then, the colorful toy beads are connected to form bead lines or bead planes.

A structure of an operation tool (bead planting toy) of the above playing manner at present is similar to a structure of a bead planting pen toy disclosed by Chinese utility model patent with the authorization announcement number of CN218451864U. The structure generally includes a pen body and a pressing rod, a pressing head is disposed above the pressing rod, and a lower end of the pen body is provided with a bead outlet hole. The pressing rod penetrates into the pen body, and the pressing head is exposed above the pen body. In the playing process, beads are placed in the pen body in advance. During planting, the pressing head above the pen body is pressed by a finger, the pressing rod is downwards pushed, and the beads are downwards pushed and pressed one by one by the lower end surface of the pressing rod, so that the beads go out of the bead outlet hole at the lower end of the pen body one by one, and beads are pushed into the round recessed holes to realize the bead planting.

The above existing bead planting pen has two problems to be solved. The first problem is that a position for storing the beads in the body cavity of the pen body is between the lower end surface of the pressing rod and the bead outlet hole, all beads stored in the body cavity of the pen body are all positioned between the lower end surface of the pressing rod and the bead outlet hole, an inner diameter of the body cavity of the pen body can be only a little greater than a diameter of the beads, two or more beads cannot be allowed to be accommodated in each cross section of the body cavity of the pen body, and if too many beads are in the cross section of the body cavity of the pen body, the beads cannot be downwards pushed by force by using the pressing rod. That is, the beads in the body cavity of the pen body can only be ranged into a vertical line from top to bottom, additionally, the body cavity of the pen body should be designed to have a small height (in the gradually downwards moving process of the push rod, the pen body is pinched by the middle finger and the thumb, and at the same time, the index finger needs to maintain a posture of being placed on the pressing head. However, the children have short fingers, so it means that the vertical moving amplitude of the pressing rod is short, and the height of the body cavity of the pen body may only be designed to be small). Due to the above two aspects, the bead containing volume of the body cavity of the pen body is small, and only several beads can be contained in the body cavity. After those beads are planted, no bead will be left in the body cavity of the pen body. Therefore, a user needs to frequently stop to supplement the beads into the body cavity of the pen body in the planting process instead of completing the bead planting of the whole picture in one step. When the beads are supplemented and guided into the body cavity of the pen body in each time, the pressing rod needs to be pulled out from the pen body, and after the bead supplementation, the pressing rod needs to be installed back into the pen body. Therefore, the operation is complicated.

The second problem is that during bead planting by using the above existing bead planting pen toy, the hand acts as follows: the pen body is tightly held to keep still, and at the same time, a push rod is downwards pressed by one finger (index finger). This action does not conform to the action of the fingers in a writing or drawing process of people with a pen in actual life (during writing or drawing with a pen in actual life, people use three fingers to hold the pen body, and drives the pen body to stamp the pen point towards the surface of the substrate material rather than putting one finger on the upper end surface of the pen to press the pen), so that the experience feeling of simulating the writing or drawing process with the above bead planting pen toy is poor.

SUMMARY

The disclosure aims at overcoming the above defects to provide a pen for planting spherical beads. The operation action process of the pen is basically the same as a pen lifting and using process in daily life of people, and a great number of beads may be contained in a pen body.

The objective may be achieved by the following solution:

The disclosure has the following advantages and effects:

I. The disclosure is mainly used for playing and may also be used in other daily life scenes such as planting spherical beads onto a substrate material. In the playing process, the spherical beads (with the diameter a little greater than a hole diameter of a bead outlet hole in a natural state) are stored in a body cavity of the pen body, a space except for a position occupied by a jacking rod inside a cavity of a vertical sliding component is also fully filled with the spherical beads. At the beginning, a gap between a lower end surface of the jacking rod and the bead outlet hole is filled with a spherical bead. The pen body is held by the thumb, the index finger and the middle finger, so that the bead outlet hole at the bottom of the vertical sliding component is aligned with a round recessed hole of a substrate material. The pen body is driven to downwards move, so that a pen point stamps the substrate material. After the bottom of the vertical sliding component is in contact with the substrate material, the vertical sliding component receives upward resistance of the substrate material and stops moving downwards, and the pen body and the jacking rod continuously move downwards. Therefore, the spherical bead positioned at the jacking rod and the bead outlet hole is pushed out of the bead outlet hole and is embedded into the round recessed hole of the substrate material, and the planting of one bead is completed. Then, the planting pen is lifted up by the thumb, the index finger and the middle finger, and the bottom end of the planting pen is suspended. Therefore, under the self gravity effect of the vertical sliding component, the vertical sliding component downwards slides relative to the pen body. When the vertical sliding component downwards slides to the lowest point of the vertical sliding track, a bead in the cavity of the vertical sliding component rolls to a position between the jacking rod and the bead outlet hole along the bottom of the inclined vertical sliding component for doing the preparation for a next time of planting. The above operation process is visible, the operation action process of the disclosure is basically the same as a pen lifting and using action process in daily life of people, the experience feeling of the playing process is enhanced, the pen may also be used for training the pen holding posture of children in future, and pen holding strength and writing strength of children may be trained (because the spherical beads can only be embedded into the round recessed holes of the substrate material with force).

II. In each downward planting action in the above process, when the vertical sliding component upwards moves relative to the pen body and the jacking rod, the vertical bead guide component of the vertical sliding component forms an upward insertion action relative to the body cavity of the pen body. Through the insertion action, the beads inside the body cavity of the pen body can be upwards stirred and jacked. Then, when the vertical sliding component downwards moves relative to the pen body and the jacking rod, a bead in the cavity of the vertical sliding component (inclined bead guide cavity passage) rolls along the bottom of the inclined vertical sliding component to roll to a position between the jacking rod and the bead outlet hole, all beads in the cavity (including the vertical bead guide tube/inclined bead guide cavity passage) of the vertical sliding component move in a supplemented manner in a direction approaching to the bead outlet hole, and the beads which are jacked and stirred just now in the body cavity of the pen body may sink. One bead will fall to the upper end of the vertical bead guide tube in a supplemented manner in the sinking process, so that the insides of the vertical bead guide tube and the cavity of the vertical sliding component are always fully filled with the beads.

III. The volume of the body cavity of the pen body of the disclosure is large, and a great number of beads may be stored in the body cavity. The reasons include: (I) a position for storing the beads in the body cavity of the pen body of the disclosure is not positioned between the lower end surface of the jacking rod and the bead outlet hole, so that the diameter of the body cavity of the pen body may not be limited by the bead diameter, that is, the diameter of the body cavity of the pen body may be several times of the bead diameter, and is not only under a unique condition of being about one time of the bead diameter; and (II) in the operation process of the disclosure, when the fingers hold the pen body, there is no requirement on one finger placed above the pen body, so that a vertical length of the pen body may be designed to be longer, and this is also beneficial to increasing the bead storage volume of the body cavity of the pen body. Due to the above two reasons, the body cavity of the pen body of the disclosure may be used for storing a great number of beads (if the diameter of the body cavity of the pen body is 3 times of the bead diameter, seven beads may be placed in the same horizontal cross section, and additionally, the pen body has a great vertical length, so that the bead storage volume may be ten or more times of that of a traditional structure).

DETAILED DESCRIPTION

Embodiment I

Figure 1:
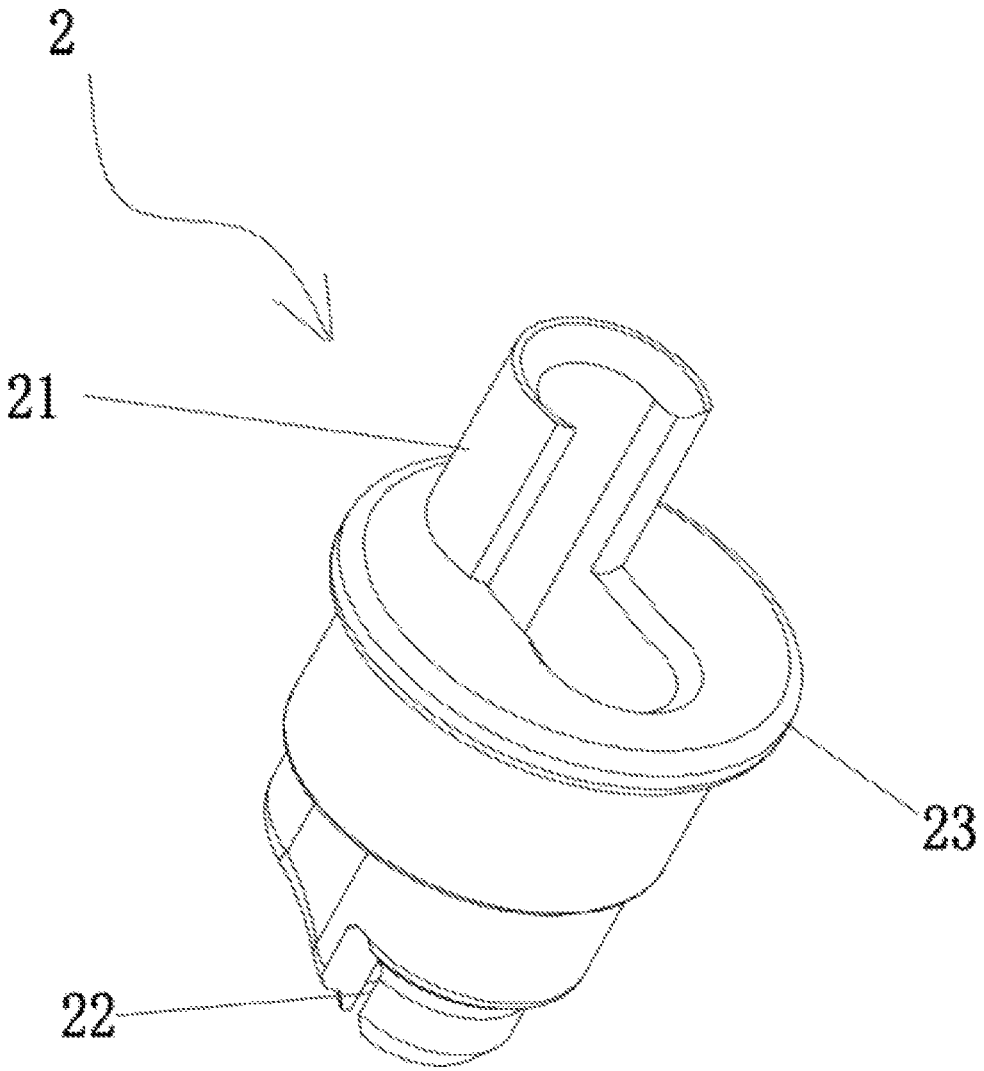
FIG. 1 is a three-dimensional structure diagram of a first specific embodiment of the disclosure.
Figure 2:
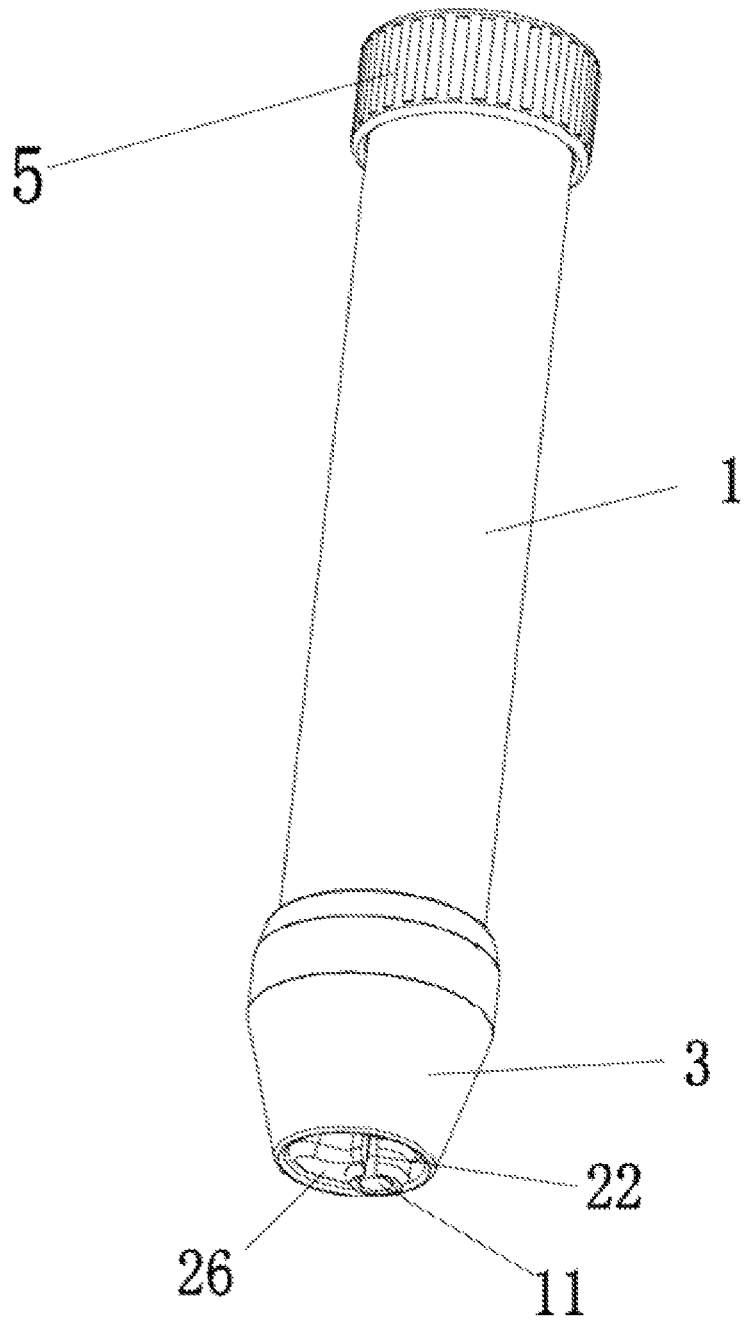
FIG. 2 is a schematic bottom view of the structure shown in FIG. 1.
Figure 3:
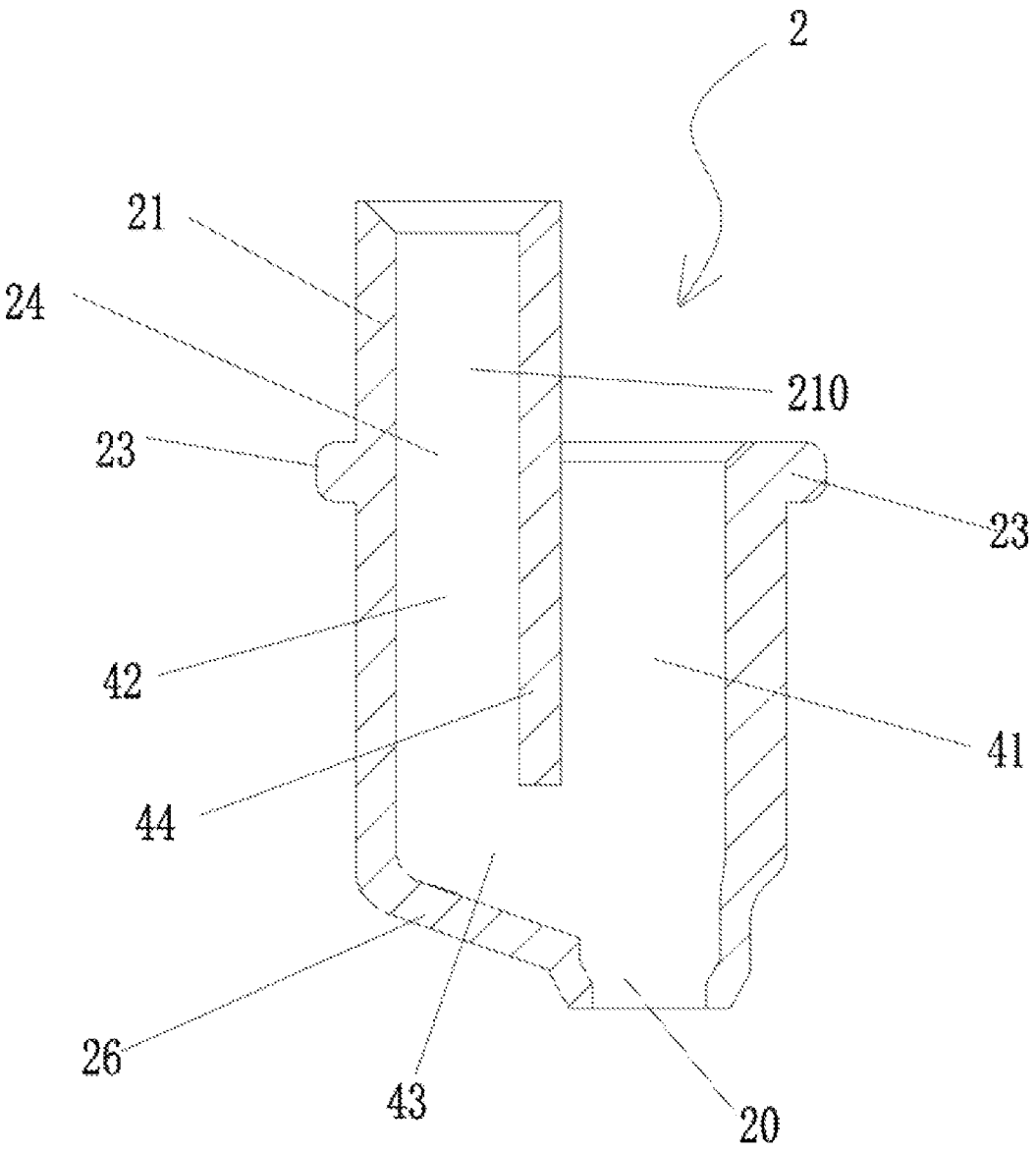
FIG. 3 is a schematic enlarged view of an A-A profile in FIG. 2.
Figure 4:
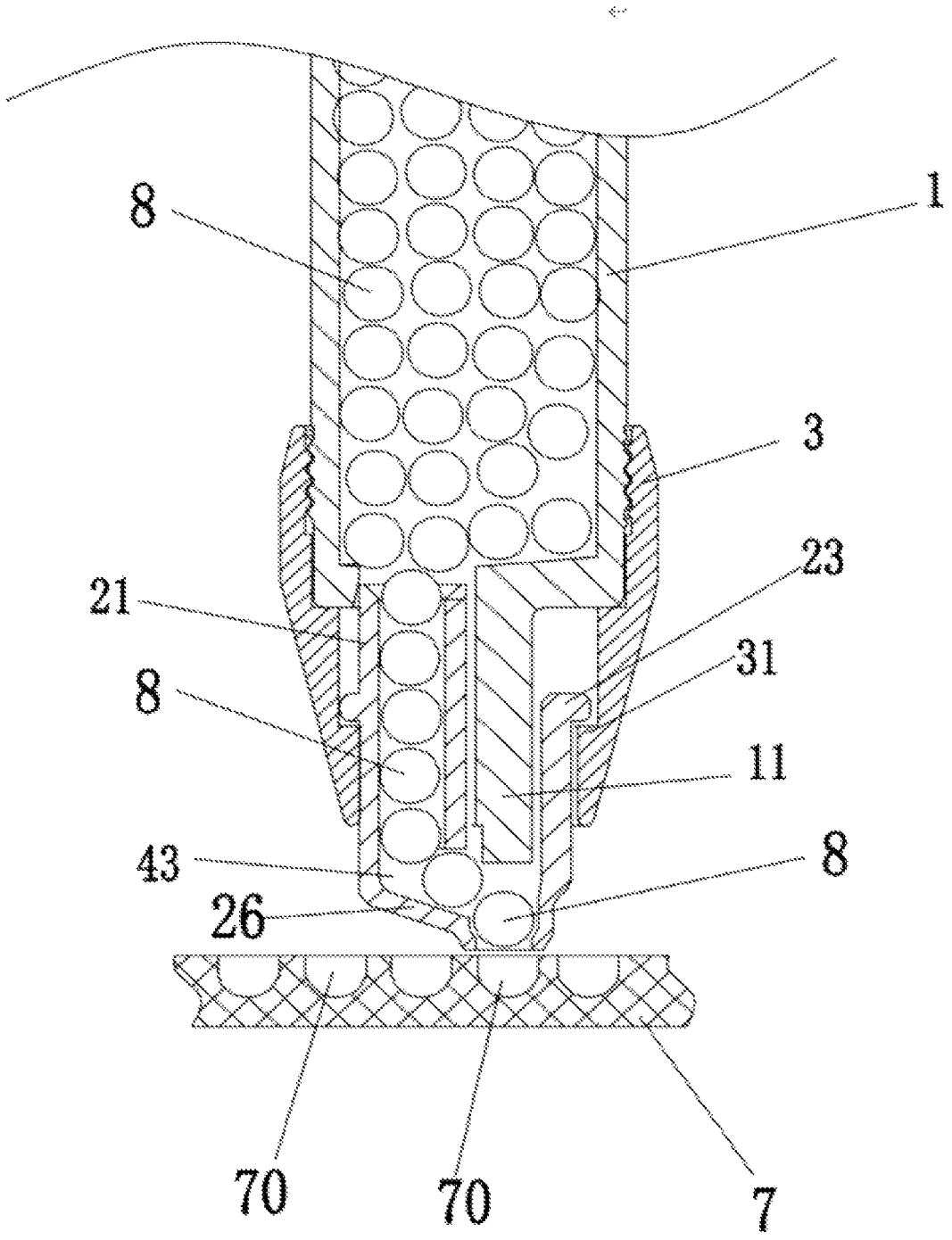
FIG. 4 is a schematic local enlarged view of a vertical sliding component in FIG. 2.
Figure 5:
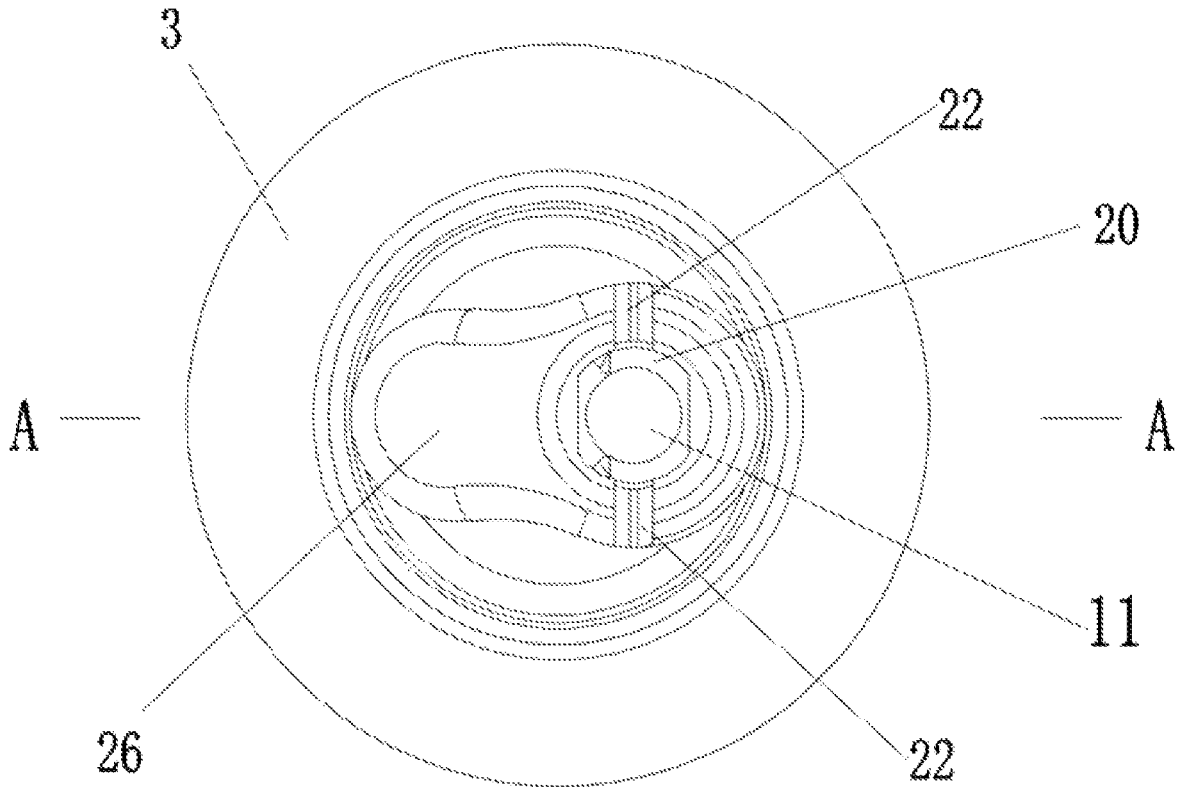
FIG. 5 is a front schematic structural view of the vertical sliding component in FIG. 2.
Figure 6:
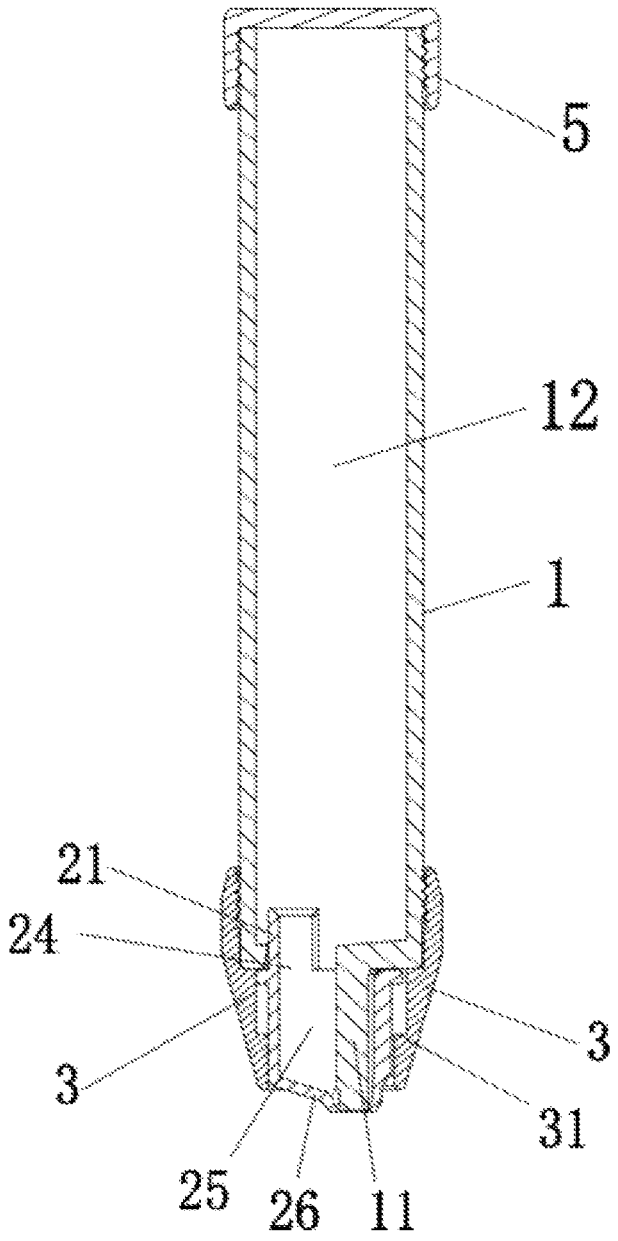
FIG. 6 is a schematic exploded view of the structure shown in FIG. 1.
Figure 7:
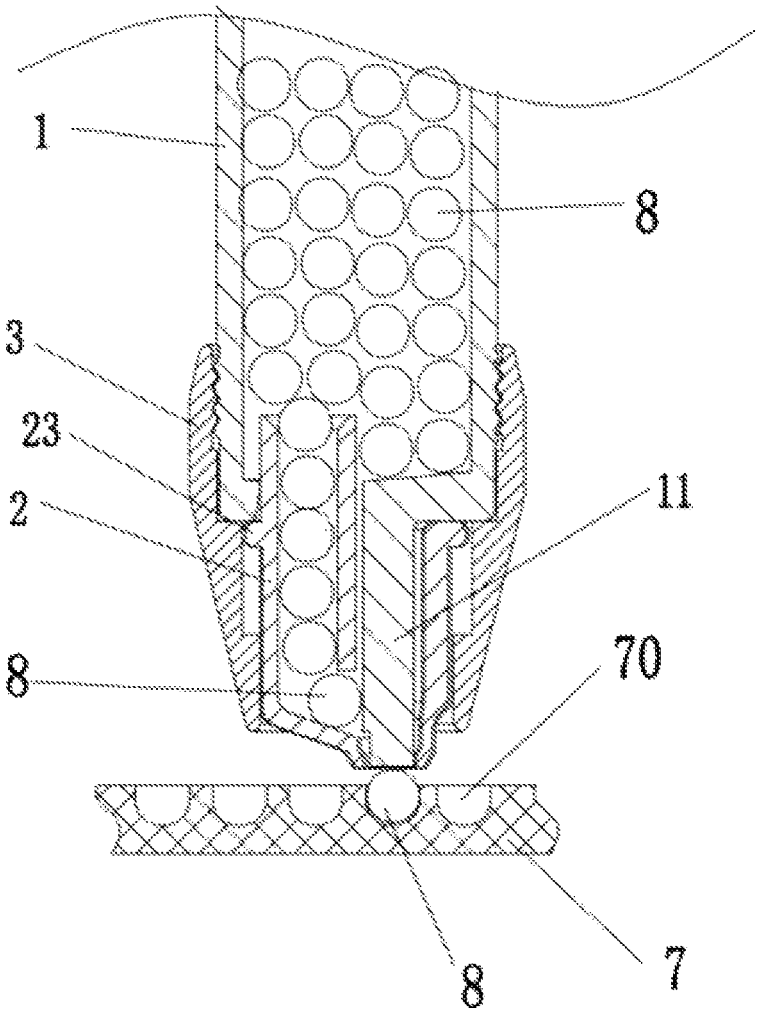
FIG. 7 is a schematic exploded view of the structure shown in FIG. 1 and expressed from another angle.

A pen for planting spherical beads includes a pen body 1 for storing beads. A hollow hole 10 is formed in a lower end of the pen body 1, a diameter of the hollow hole 10 is smaller than an inner diameter of a body cavity 12 of the pen body, and a jacking rod 11 vertically extending in a downward direction is also fixedly connected under the pen body 1. A vertical sliding component 2 is disposed under the pen body 1 in a vertically slidable manner. A cavity is formed inside the vertical sliding component 2, a bead inlet hole 24 is formed on the top of the cavity of the vertical sliding component, a bead outlet hole 20 is formed in the bottom of the cavity of the vertical sliding component, and a deformation seam 22 is formed in an edge of the bead outlet hole 20. A bottom 26 of the vertical sliding component is inclined, and the bead outlet hole 20 is positioned at the lowest end of the cavity of the vertical sliding component. The vertical sliding component 2 further includes a vertical bead guide component 21, a cross section of the vertical bead guide component 21 is round and forms a vertical bead guide tube. The vertical bead guide tube 21 is positioned at an upper portion of the vertical sliding component, a lower end of the vertical bead guide tube 21 is positioned at an edge of the bead inlet hole 24. An upper end opening of the vertical bead guide tube 21 faces the body cavity 12 of the pen body. A lower end of a tube cavity 210 of the vertical bead guide tube 21 communicates with the bead inlet hole 24 at the top of the cavity of the vertical sliding component. The vertical bead guide tube 21 upwards penetrates into the hollow hole 10 at the lower end of the pen body. The vertical bead guide tube 21 can guide spherical beads in the body cavity of the pen body into the bead inlet hole 24.

A cavity inside the vertical sliding component includes a jacking rod hole cavity 41, a vertical bead guide hole cavity 42 and an inclined bead guide cavity passage 43. The vertical bead guide hole cavity 42 is positioned right under the tube cavity of the vertical bead guide tube 21. The jacking rod hole cavity 41 is positioned beside the vertical bead guide hole cavity 42, and the jacking rod 11 downwards penetrates into the jacking rod hole cavity 41 (the jacking rod hole cavity is mainly used for accommodating the jacking rod 11, and is thus named as the jacking rod hole cavity). The bead outlet hole 20 is positioned right under the jacking rod hole cavity 41, a lower end surface of the jacking rod 11 is aligned with the bead outlet hole 20, and both the lower end of the jacking rod hole cavity 41 and the lower end of the vertical bead guide hole cavity 42 communicate with the inclined bead guide cavity passage 43.

As shown in FIG. 2, FIG. 1, FIG. 7, FIG. 6 and FIG. 3, a pen point outer sheath 3 is disposed outside the vertical sliding component 2, the bottom end of the pen point outer sheath 3 forms an outer sheath hole 30, and an upper end of the pen point outer sheath 3 is connected with a lower end of the pen body 1. The lower portion of the vertical sliding component 2 downwards penetrates out of the outer sheath hole 30 of the pen point outer sheath. The pen point outer sheath 3 limits the lowest point of the vertical sliding track of the vertical sliding component 3. Specifically, the vertical sliding component 2 forms an annular convex rib 23, and an annular step 31 is formed on an inner peripheral surface of the pen point outer sheath 3. When the vertical sliding component 2 downwards slides to the lowest point relative to the pen body 1, the step surface of the annular step 31 prevents the annular convex rib 23 of the vertical sliding component 2 from continuously sliding downwards. When the vertical sliding component 2 downwards slides to the lowest point of the vertical sliding track relative to the pen body 1, a vertical distance between the lower end surface of the jacking rod 11 and the bead outlet hole 20 is able to accommodate a spherical bead 8.

Figure 8:
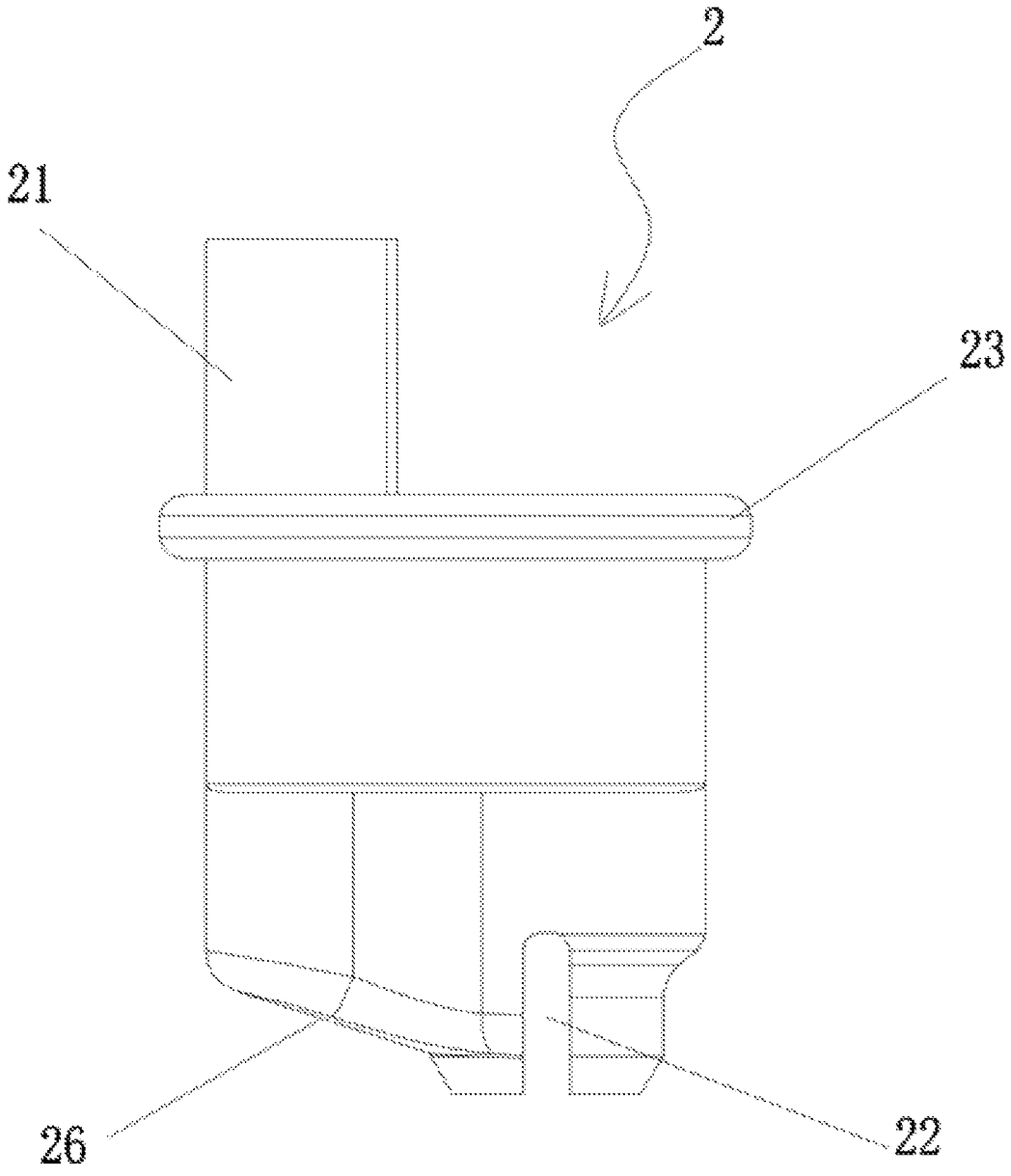
FIG. 8 is a schematic local structure diagram when a pen point just approaches to a substrate material in a bead planting process (i.e., use process) according to the first specific embodiment of the disclosure.
Figure 9:
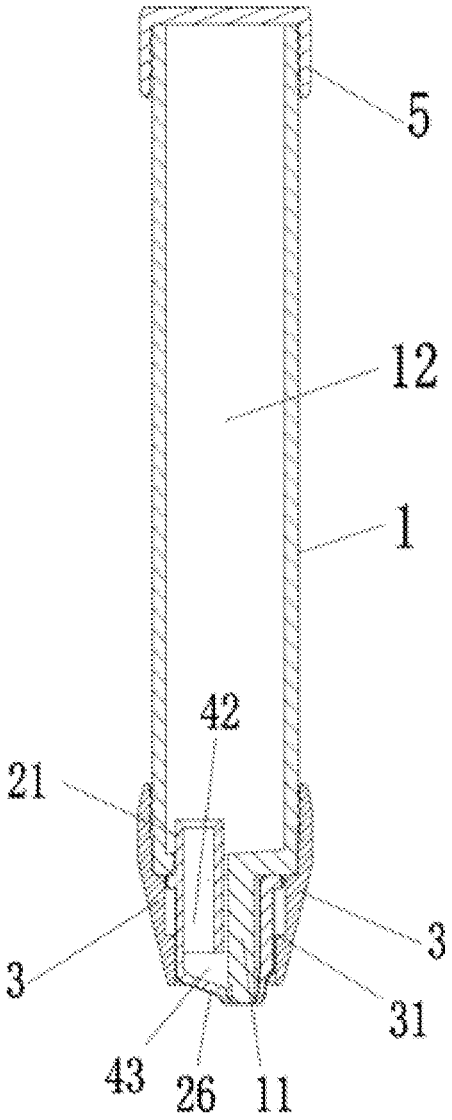
FIG. 9 is a change state schematic diagram of the structure shown in FIG. 8 after a lowest bead toy is pushed out from a bead outlet hole of a vertical sliding component and is embedded in a recessed hole of a substrate material.
Figure 10:
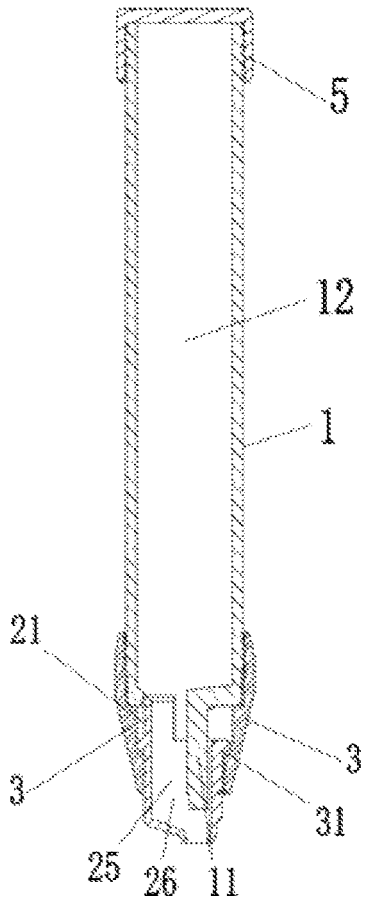
FIG. 10 is a change state schematic diagram after a planting pen shown in FIG. 9 is lifted to be in a suspended state.

The above embodiment has the following principle and use manner:

In the use process (such as a playing process), spherical beads 8 are stored in the body cavity of the pen body 1, and the diameter of the spherical beads 8 is a little greater than the hole diameter of the bead outlet hole 20 in a natural state. The vertical bead guide hole cavity 42 and the inclined bead guide cavity passage 43 inside the cavity of the vertical sliding component 2 are also fully filled with the spherical beads 8. A gap between the lower end surface of the jacking rod 11 and the bead outlet hole 20 is also filled with a spherical bead 8, as shown in FIG. 8. The pen body 1 is held by the thumb, the index finger and the middle finger, and the bead outlet hole 20 at the bottom of the vertical sliding component is aligned with a round recessed hole 70 of a substrate material 7, as shown in FIG. 8. The pen body 1 is driven to downwards move, so that a pen point punches (stamps) the substrate material 7. When the bottom of the vertical sliding component 2 is in contact with the substrate material 7, the vertical sliding component 2 receives upward resistance of the substrate material 7 and stops moving downwards, and the pen body 1 and the jacking rod 11 continuously move downwards. Therefore, the spherical bead 8 positioned at the jacking rod 11 and the bead outlet hole 20 is pushed out of the bead outlet hole 20 and is embedded into the round recessed hole 70 of the substrate material, and the planting of one bead is completed, as shown in FIG. 9. Then, the planting pen is lifted up by the thumb, the index finger and the middle finger, and the bottom end of the planting pen is suspended. Therefore, under the self gravity effect of the vertical sliding component 2, the vertical sliding component 2 downwards slides relative to the pen body 1. When the vertical sliding component 2 downwards slides to the lowest point of the vertical sliding track (i.e., when the step surface of the annular step 31 blocks the annular convex rib 23 of the vertical sliding component 2), a bead 8 in the inclined bead guide cavity 43 rolls to a position between the jacking rod 11 and the bead outlet hole 20 along the bottom 26 of the inclined vertical sliding component, as shown in FIG. 10, for doing the preparation for a next time of planting.

In each downward planting action of the above process, when the vertical sliding component 2 upwards moves relative to the pen body 1 and the jacking rod 11, the vertical bead guide tube 21 of the vertical sliding component forms an upward insertion action relative to the body cavity of the pen body. Through the insertion action, the spherical beads 8 inside the body cavity of the pen body can be upwards stirred and jacked. Then, the vertical sliding component 2 downwards moves relative to the pen body (including the vertical bead guide tube 21). In this process, a bead 8 in the inclined bead guide cavity passage 43 rolls along the bottom 26 of the inclined vertical sliding component to be supplemented between the jacking rod 11 and the bead outlet hole 20. All beads in the vertical bead guide tube 21/vertical bead guide hole cavity 42 move for a distance of the diameter of one bead in a direction approaching to the bead outlet hole, and downwards move at any time along the vertical bead guide tube 21. The beads 8 which are jacked and stirred just now in the body cavity of the pen body 1 may sink, and one bead 8 will fall to the upper end of the vertical bead guide tube 21 in a supplemented manner in a sinking process, so that the insides of the vertical bead guide tube 21 and the inclined bead guide cavity passage 43 are always fully filled with the beads, and the bead 8 can be continuously supplemented to the position between the jacking rod 11 and the bead outlet hole 20.

Embodiment II

Figure 11:
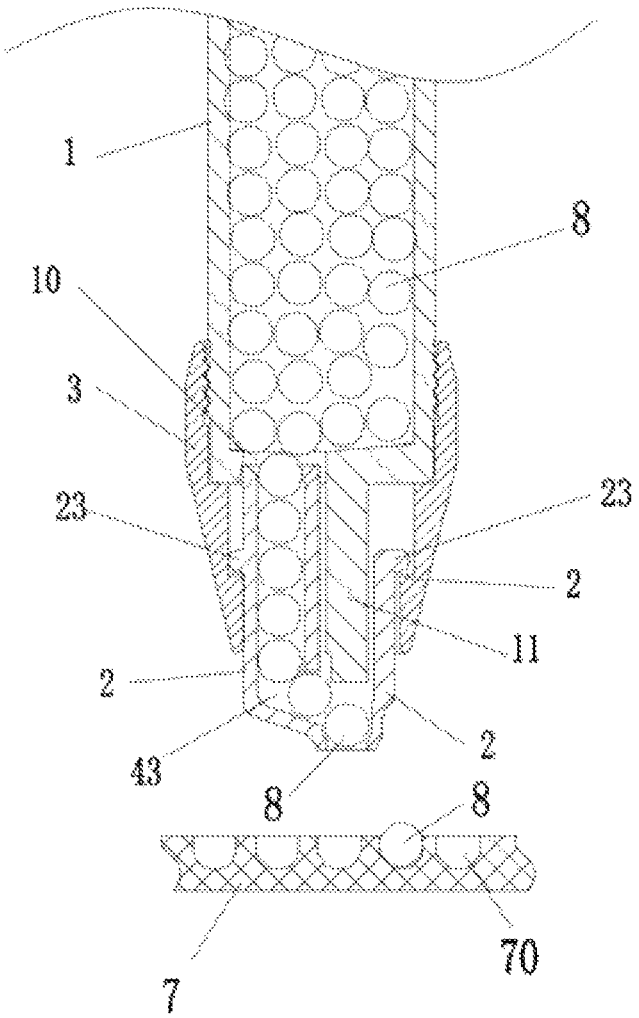
FIG. 11 is a schematic profile structure diagram of a vertical sliding component of a second specific embodiment of the disclosure.
Figure 12:
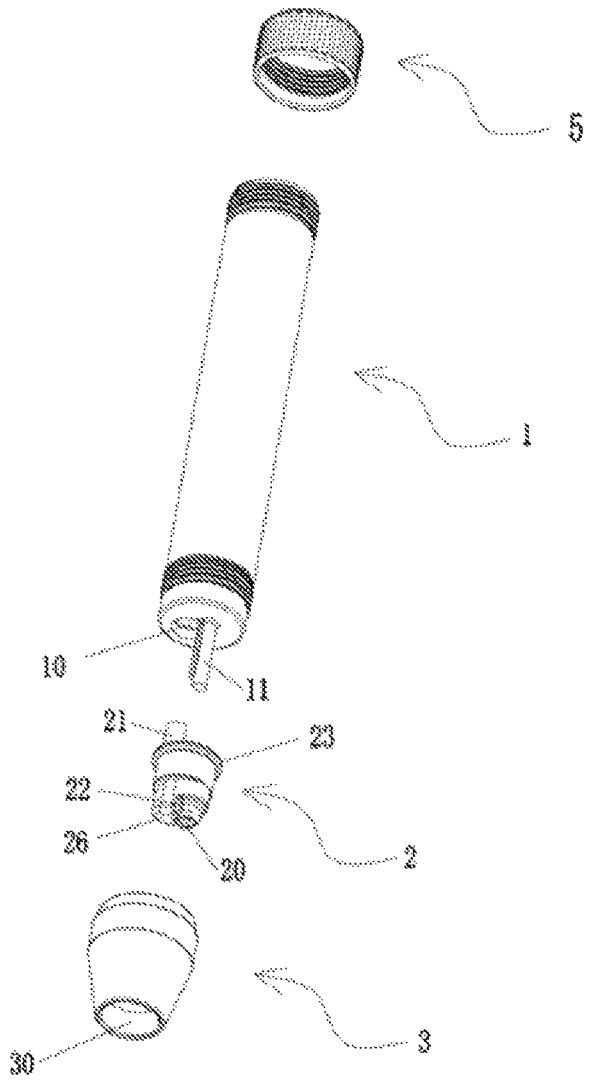
FIG. 12 is a three-dimensional structure diagram of the vertical sliding component of the second specific embodiment of the disclosure.

There are mainly two differences between Embodiment II and Embodiment I. The first difference is that a cross section of a vertical bead guide component 21 in Embodiment II is in an arc shape and forms a vertical bead guide groove, as shown in FIG. 12. A groove cavity 210 of the vertical bead guide groove 21 forms a bead guide passage for guiding spherical beads 8 in a body cavity of a pen body into a bead inlet hole, as shown in FIG. 11, FIG. 12, FIG. 13 and FIG. 14.

Figure 13:
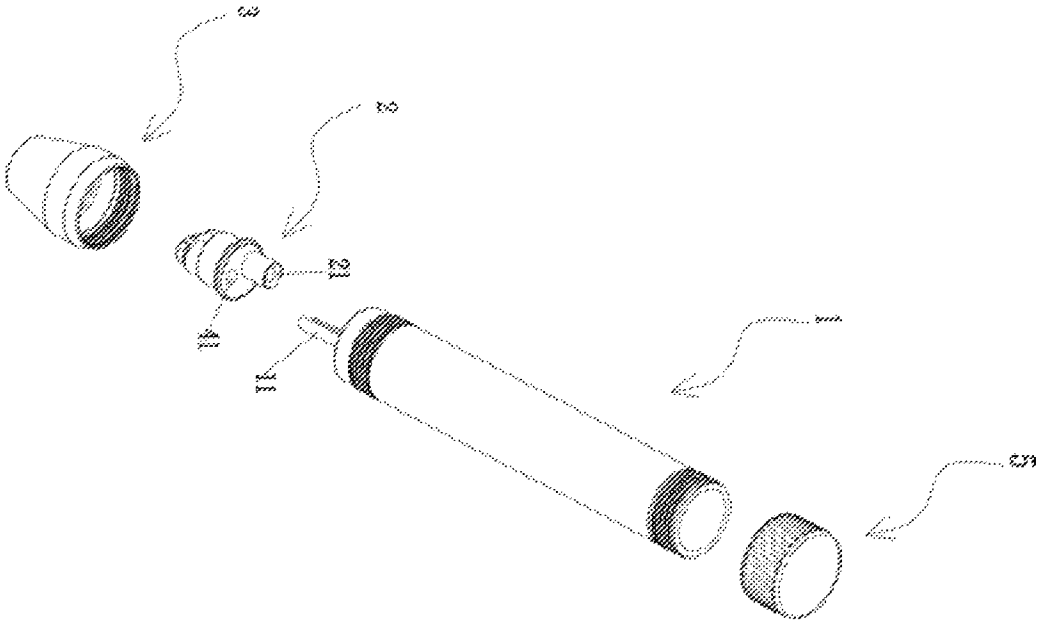
FIG. 13 is a profile structure diagram when the vertical sliding component is in a highest point of a moving track according to the second specific embodiment of the disclosure.

The second difference between Embodiment II and Embodiment I is that a structure of a cavity inside the vertical sliding component in Embodiment II is different from the structure of the cavity of Embodiment I. Specifically, no separation wall is formed inside the cavity in the vertical sliding component 2 of Embodiment II. Therefore, the cavity inside the vertical sliding component 2 of Embodiment II is a general cavity 25 instead of being divided into a jacking rod hole cavity, a vertical bead guide hole cavity and an inclined bead guide cavity passage, as shown in FIG. 11, FIG. 12 and FIG. 13. A jacking rod 11 in Embodiment II downwards penetrates into the general cavity 25, and a groove cavity of the vertical bead guide groove 21 in Embodiment II directly communicates with the general cavity 25.

Other structures of Embodiment II are the same as those of Embodiment I, and include a pen body 1, a pen body cover 5, a pen point outer sheath 3 having the same structure as Embodiment I, and a bead outlet hole 20 of the vertical sliding component and an annular convex rib 23 having the same structures as those of Embodiment I.

Figure 14:
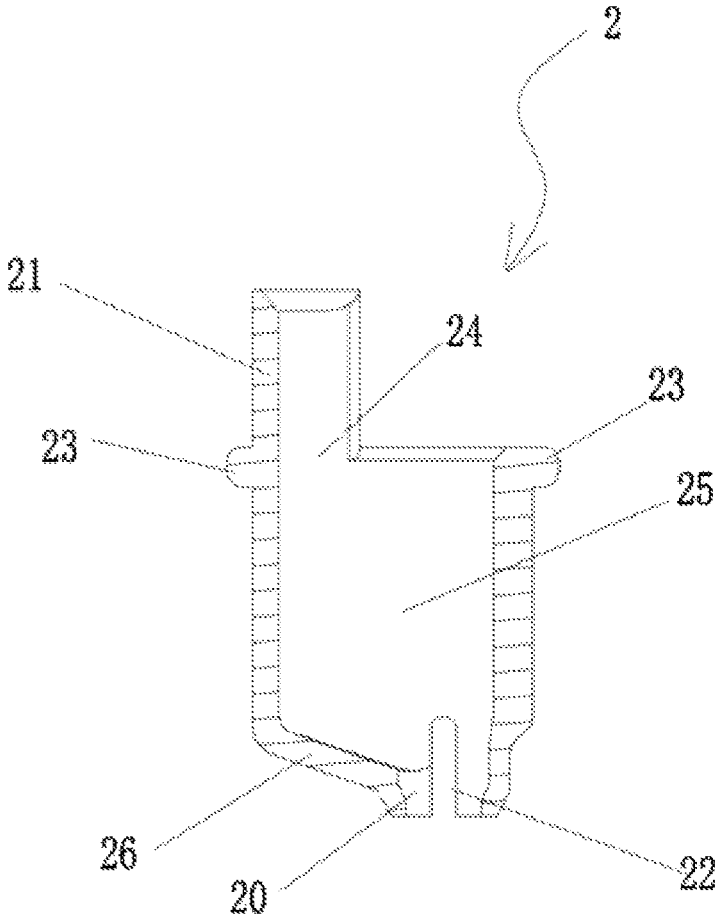
FIG. 14 is a profile structure diagram when the vertical sliding component is in the lowest point of the moving track according to the second specific embodiment of the disclosure.

A use method of Embodiment II is the same as that of Embodiment I. According to Embodiment II, when the vertical sliding component is in a highest point of a moving track, a gap between the lower end surface of the jacking rod 11 and the bead outlet hole 20 may be filled with a spherical bead, as shown in FIG. 14, so after the jacking rod 11 continuously presses down, the spherical bead may be pushed out of the gap between the lower end surface of the jacking rod 11 and the bead outlet hole 20, as shown in FIG. 13.

Pen body 1
Hollow hole 10 formed in a lower end of the pen body
Jacking rod 11
Cavity 25 formed inside a vertical sliding component
Bottom wall 26
Vertical sliding component 2
Vertical bead guide tube 21 included in the vertical sliding component
Bead outlet hole 20 formed at the bottom of the vertical sliding component
Deformation seam 22 formed at an edge of the bead outlet hole
Annular convex rib 23 formed at an upper portion of the vertical sliding component
Bead inlet hole 24
Pen point outer sheath 3 disposed outside the vertical sliding component
Outer sheath hole 30 formed at a bottom end of the pen point outer sheath
Pen point outer sheath step 31
Jacking rod hole cavity 41 included in the cavity formed inside the vertical sliding component
Vertical bead guide hole cavity 42
Inclined bead guide cavity passage 43
Isolation block 44
Pen body cover 5 screwed on an upper end of the pen body
Beads 8
Substrate material 7
Recessed holes 70

What is claimed is:

1. A pen for planting spherical beads, comprising a pen body for storing beads, wherein a hollow hole is formed in a lower end of the pen body, a diameter of the hollow hole is smaller than an inner diameter of a body cavity of the pen body, and a jacking rod vertically extending in a downward direction is also fixedly connected under the pen body; a vertical sliding component is disposed under the pen body in a vertically slidable manner; a cavity is formed inside the vertical sliding component, a bead inlet hole is formed on the top of the cavity of the vertical sliding component, a bead outlet hole is formed in the bottom of the cavity of the vertical sliding component, the bottom of the vertical sliding component is inclined, and the bead outlet hole is positioned at the lowest end of the cavity of the vertical sliding component; the jacking rod downwards penetrates into the cavity of the vertical sliding component, and a lower end surface of the jacking rod is aligned with the bead outlet hole; and when the vertical sliding component downwards slides to the lowest point of a vertical sliding track relative to the pen body, a vertical distance between the lower end surface of the jacking rod and the bead outlet hole is able to accommodate a spherical bead.

2. The pen for planting spherical beads according to claim 1, wherein a deformation seam is formed on an edge of the bead outlet hole.

3. The pen for planting spherical beads according to claim 1, wherein the vertical sliding component further comprises a vertical bead guide component, the vertical bead guide component is positioned at an upper portion of the vertical sliding component, a lower end of the vertical bead guide component is positioned at an edge of the bead inlet hole, and the vertical bead guide component penetrates into the hollow hole formed at the lower end of the pen body.

4. The pen for planting spherical beads according to claim 3 wherein a cross section of the vertical bead guide component is in an arc shape and forms a vertical bead guide groove, and a groove cavity of the vertical bead guide groove forms a bead guide passage for guiding the spherical beads in the body cavity of the pen body into the bead inlet hole.

5. The pen for planting spherical beads according to claim 3 wherein a cross section of the vertical bead guide component is in a round shape and forms a vertical bead guide tube, and an upper end opening of the vertical bead guide tube faces the body cavity of the pen body; and the lower end of a tube cavity of the vertical bead guide tube communicates with the bead inlet hole at the top of the cavity of the vertical sliding component.

6. The pen for planting spherical beads according to claim 5, wherein the cavity inside the vertical sliding component includes a jacking rod hole cavity, a vertical bead guide hole cavity and an inclined bead guide cavity passage, the vertical bead guide hole cavity is positioned right under the tube cavity of the vertical bead guide tube, the jacking rod hole cavity is positioned beside the vertical bead guide hole cavity, the jacking rod downwards penetrates into the jacking rod hole cavity, the bead outlet hole is positioned right under the jacking rod hole cavity, and the lower end of the jacking rod hole cavity and the lower end of the vertical bead guide hole cavity communicate with the inclined bead guide cavity passage.

7. The pen for planting spherical beads according to claim 3, wherein a deformation seam is formed on an edge of the bead outlet hole.

8. The pen for planting spherical beads according to claim 1, wherein the lower end of the pen body is connected with a pen point outer sheath, a bottom end of the pen point outer sheath forms an outer sheath hole, a lower portion of the vertical sliding component downwards penetrates out of the outer sheath hole of the pen point outer sheath, and the pen point outer sheath limits the lowest point of the vertical sliding track of the vertical sliding component.

9. The pen for planting spherical beads according to claim 8, wherein the vertical sliding component forms an annular convex rib, and an inner peripheral surface of the pen point outer sheath forms an annular step; and when the vertical sliding component downwards slides to the lowest point relative to the pen body, a step surface of the annular step prevents the annular convex rib of the vertical sliding component from continuously sliding downwards.

10. The pen for planting a spherical bead according to claim 8 wherein a cross section of the vertical bead guide component is in an arc shape and forms a vertical bead guide groove, and a groove cavity of the vertical bead guide groove forms a bead guide passage for guiding the spherical beads in the body cavity of the pen body into the bead inlet hole.

11. The pen for planting a spherical bead according to claim 8 wherein a cross section of the vertical bead guide component is in a round shape and forms a vertical bead guide tube, and an upper end opening of the vertical bead guide tube faces the body cavity of the pen body; and the lower end of a tube cavity of the vertical bead guide tube communicates with the bead inlet hole at the top of the cavity of the vertical sliding component.

12. The pen for planting spherical beads according to claim 8, wherein a deformation seam is formed on an edge of the bead outlet hole.

13. The pen for planting a spherical bead according to claim 9 wherein a cross section of the vertical bead guide component is in an arc shape and forms a vertical bead guide groove, and a groove cavity of the vertical bead guide groove forms a bead guide passage for guiding the spherical beads in the body cavity of the pen body into the bead inlet hole.

14. The pen for planting a spherical bead according to claim 9 wherein a cross section of the vertical bead guide component is in a round shape and forms a vertical bead guide tube, and an upper end opening of the vertical bead guide tube faces the body cavity of the pen body; and the lower end of a tube cavity of the vertical bead guide tube communicates with the bead inlet hole at the top of the cavity of the vertical sliding component.

15. The pen for planting spherical beads according to claim 9, wherein a deformation seam is formed on an edge of the bead outlet hole.

* * * * *